United States Patent [19]

Magnuson

[11] Patent Number: 4,631,996

[45] Date of Patent: Dec. 30, 1986

[54] PUNCH PRESS WITH SELF-ADJUSTING STRIPPER

[75] Inventor: James M. Magnuson, Kankakee, Ill.

[73] Assignee: Peddinghaus Corporation, Bradley, Ill.

[21] Appl. No.: 792,328

[22] Filed: Oct. 28, 1985

[51] Int. Cl.[4] ..... B26F 1/02

[52] U.S. Cl. ..... 83/23; 83/129; 83/137; 83/390; 83/639

[58] Field of Search ..... 83/129, 130, 132, 133, 83/137, 390, 639, 23

[56] References Cited

U.S. PATENT DOCUMENTS

| | | | |
|---|---|---|---|
| 1,784,397 | 12/1930 | Tewes . | |
| 2,267,517 | 12/1941 | Barney . | |
| 2,353,488 | 7/1944 | Mueller | 83/137 |
| 2,585,852 | 2/1952 | Sandberg . | |
| 2,914,981 | 12/1959 | Roeber . | |
| 3,720,125 | 3/1973 | Scott | 83/146 |
| 3,722,337 | 3/1973 | Brolund | 83/137 |

*Primary Examiner*—James M. Meister

*Attorney, Agent, or Firm*—Dressler, Goldsmith, Shore, Sutker & Milnamow, Ltd.

[57] ABSTRACT

A punch press having a self-adjusting stripper member is disclosed whereby stripping of the press punching tool from a workpiece is automatically effected attendant to effecting a return stroke of the press actuator. The construction includes a press frame upon which is mounted a double-acting fluid actuator, with the actuator being mounted for limited relative movement with respect to the frame. A piston rod of the actuator carries a punching tool for effecting punching of a workpiece. Notably, a stripper member is operatively connected to the housing of the actuator for movement therewith with respect to the press frame, with the stripper normally positioned to provide a large running clearance relative to the workpiece. During reverse pressurization of the press actuator for the return stroke of the punching tool, the actuator cylinder and stripper first move toward the workpiece and the stripper firmly clamps the workpiece against the press frame, with continued pressurization effecting stripping of the punching tool from the workpiece.

12 Claims, 4 Drawing Figures

PUNCH PRESS WITH SELF-ADJUSTING STRIPPER

TECHNICAL FIELD

The present invention pertains to punch presses. More particularly, the present invention pertains to an apparatus and method of operating a punch press having a self-adjusting stripper member for effecting withdrawal of the press punch from a workpiece.

BACKGROUND OF THE INVENTION

Fluid-pressure operated punch presses are often used in metal forming operations. Such presses usually include a supporting frame and a fixedly mounted double-acting fluid actuator. A typical actuator used for operating a punch press includes a reciprocable piston movably mounted in an actuator cylinder, whereby a pair of fluid chambers are defined which can be selectively pressurized for "stroking" the piston in one direction or the other.

Fluid pressure, either hydraulic or pneumatic, is used to drive a punch or like tool carried by the piston rod of the actuator into the workpiece. To remove or strip the tool from the workpiece, it is necessary to clamp the workpiece temporarily. This is because the force required for removal of the tool is relatively high, typically about one-third of the force required by effecting punching. Known clamps have sometimes required additional power sources to activate them for gripping the workpiece. In addition, known clamp arrangements typically do not provide a large running clearance between the stripper and the workpiece. If the workpiece is bent or otherwise out of tolerance, it may not fit under the stripper clamp, thus requiring adjustment of the clamp, thereby detracting from the effeciency of the punching operation.

Accordingly, there continues to be a need for a stripper unit for a punch press that provides the greatest possible running clearance between the workpiece and the stripper, and that securely grips the workpiece during the return stroke of the press punch for stripping. Preferably, such an arrangement is configured such that it does not require additional actuation devices and can be operated attendant to fluid pressurization of the press double-acting actuator, and is configured for reliable and efficient operation.

SUMMARY OF THE INVENTION

In accordance with the invention, a punch press having a self-adjusting stripper member is disclosed. Notably, the stripper does not require any additional driving means for effecting gripping of a workpiece, but rather is operated attendant to pressurization of the press actuator for effecting the return stroke of the punching tool. A large running clearance between the stripper and the workpiece is desirably provided, yet the stripper is automatically and efficiently brought into contact with the workpiece during withdrawal of the press punching tool.

The punch press construction embodying the present invention includes a supporting press frame upon which a workpiece can be positioned for punching operations. The present press further includes a double-acting fluid actuator, which in the illustrated embodiment is hydraulically-operated. The actuator includes an actuator cylinder or housing within which is disposed an actuator piston for reciprocable movement. Notably, the actuator cylinder is not fixedly mounted on the press frame, but rather is carried on the frame by resilient biasing spring means which permit limited vertical movement of the cylinder relative to the frame.

A tool-carrying piston rod or ram is affixed to the actuator piston, with a punching tool affixed to the lower end thereof. Hydraulic pressure can be used to forcibly move the piston rod, and thus the tool, downwardly into the workpiece positioned on the press frame, with reversal of hydraulic pressure effecting a return stroke of the actuator for extracting the tool from the workpiece.

A workpiece-gripping stripper member is affixed to the actuator cylinder, and is movable with the cylinder relative to the press frame. The stripper member temporarily clamps the workpiece against the press frame while the punching tool is being extracted, with this action achieved in view of the limited relative movement which is permitted between the actuator cylinder and the press frame.

In operation, hydraulic pressure is provided to the press actuator to first drive the tool into the workpiece. Hydraulic pressure is then reversed for effecting the return stroke of the actuator piston to extract the tool from the workpiece. Bearing in mind that very substantial force is required for stripping the tool from the workpiece, the increasing reversed hydraulic pressure acts to first move the resiliently-mounted actuator cylinder, and thus the stripper member, toward the workpiece relative to the spacially fixed actuator piston. Thus, as the actuator cylinder moves, it carries the stripper member into clamping contact with the workpiece.

When the stripper member engages the workpiece, it firmly clamps same against the press frame, and the relative movement of the actuator housing and stripper with respect to the frame ceases. The increasing hydraulic pressure then drives the actuator piston and punching tool away from the workpiece to withdraw the tool, and stripping is complete. With the tool stripped from the workpiece, the actuator piston is no longer spacially fixed, and the actuator housing and stripper can therefore move away from the workpiece to provide the desired running clearance. When the actuator piston has completed its return stroke, the reverse fluid pressure can be relieved, the workpiece exchanged or repositioned, and the tool can again be driven toward the workpiece to repeat the cycle of operation.

In the preferred form of the present invention, the tool-carrying actuator piston rod is movable axially through a vertically-oriented sleeve bushing positioned in the press frame. The sleeve bushing operatively connects the actuator cylinder and stripper member, and is movable axially relative to the frame. An upper end of the sleeve bushing is affixed to the actuator cylinder, while a lower end of the sleeve bushing is affixed to the stripper member.

Springs or other resilient biasing members can be used to support the actuator cylinder above the press frame for limited vertical movement with respect thereto. The resilient members need only support the actuator against the force of gravity, with the actuator cylinder (and stripper member) moving in opposition to the biasing members during tool stripping, as described above.

Thus, in accordance with the present invention, a method of punching a workpiece and stripping a punching tool therefrom is provided. The method includes:

providing a punch press having a frame, and double-acting fluid actuator having a cylinder and reciprocable piston means movable within the cylinder, wherein the cylinder is mounted on the frame for limited movement with respect thereto;

providing a punching tool carried by the piston means for reciprocation therewith;

providing a stripper member operatively connected to the cylinder for movement therewith relative to the press frame;

positioning a workpiece on the frame, and operating the actuator to move the piston means to drive the tool into the workpiece, and operating the actuator to effect a return stroke of the piston means to withdraw the tool from the workpiece, whereby the cylinder and the stripper member first move relative to the frame toward the workpiece so that the stripper member engages the workpiece, with further operation of the actuator acting to withdraw the tool from the workpiece.

Numerous other features and advantages of the present invention will become readily apparent from the following detailed description of the invention and the embodiments thereof, from the claims and from the accompanying drawings in which the details of the invention are fully anc completely disclosed as part of this specification.

DETAILED DESCRIPTION

Figure 2:
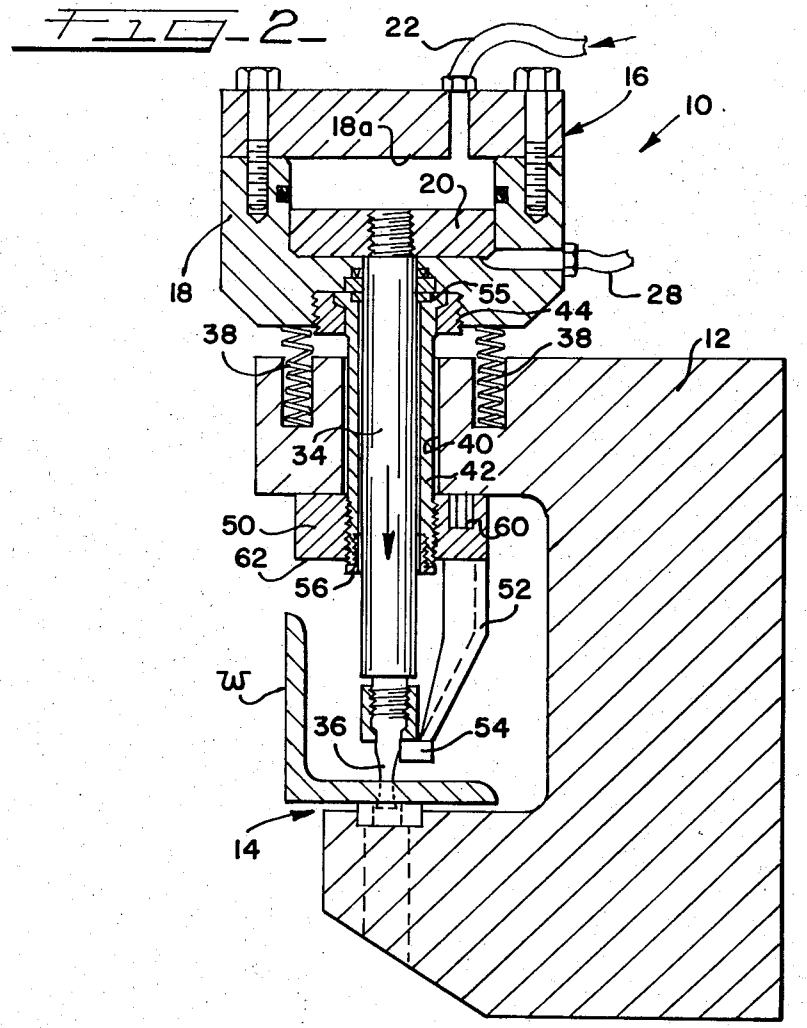
FIG. 2 is a side elevational view of the punch press and stripper of FIG. 1 illustrating the relative relationship between the tool-carrying actuator piston and the stripper after the tool has been driven into a workpiece.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

For purposes of clarity of the present disclosure, terms of orientation such as upwardly, downwardly, and the like are employed with reference to the appended drawings. However, it is to be understood that a punch press having a workpiece stripper embodying the principles of the present invention can be made and operated in an orientation other than that specifically illustrated.

With reference to the drawings, a punch press having a stripper, generally designated 10, is illustrated. The punch press and stripper 10 includes a frame 12 of a conventional configuration which is preferably generally of a C-shape for convenient operator access to the press work area. The frame 12 has a workpiece supporting area indicated generally at 14 whereat a workpiece W may be supported during a punching operation.

The punch press 10 also includes a selectively operable, double-acting fluid actuator generally indicated at 16 for effecting punching operations. The illustrated actuator 16 is configured for operation by pressurized hydraulic fluid, and includes a cylinder or housing 18 within which is movable a reciprocable piston 20. As will be appreciated, a punch press and stripper embodying the present invention may be readily configured for pneumatic operation.

The actuator piston 20 can be moved toward and away from the workpiece W by means of selective pressurization of actuator 16 with hydraulic fluid. The hydraulic fluid can be introduced under pressure via a line 22 into a region or chamber **18*a* of the actuator. Introducton of pressurized hydraulic fluid into the actuator 16 via the line 22 acts to force the piston 20** downwardly toward the workpiece W for effecting punching thereof.

A second hydraulic line 28 is provided for supplying pressurized hydraulic fluid into a region or chamber **18*b* of the actuator for moving the piston 20** away from the workpiece W for effecting the piston's return stroke.

Attached to the double-acting reciprocable piston 20 is a preferably cylindrical piston rod or ram 34. The piston rod 34 may be oriented generally vertically and carries at a lower end thereof a punch or like tool 36. The punch 36 may be moved into and withdrawn from the workpiece W by supplying pressurized hydraulic fluid to the actuator 16 by means of the lines 22 and 28, respectively.

Significantly, the cylinder 18 of the actuator 16 is not fixedly mounted on the press frame 12, but rather is resiliently supported for limited vertical movement with respect to the frame 12 by springs 38. The springs 38 need only exert sufficient force to support the actuator 16 against the force of gravity. The cooperative interaction between the actuator cylinder 18 and frame 12 for effecting stripping will be discussed subsequently.

The C-frame 12 defines a bore or passage 40, which can be cylindrical, in an upper portion thereof. Positioned in the passage 40 is a preferably cylindrical sleeve bushing 42, which extends beyond the ends of the passage. The sleeve bushing 42 is mechanically coupled via a locking ring 44 to the housing 18. As is discussed in more detail subsequently, the sleeve bushing 42 can move axially in the passage 40 independently of the piston rod 34.

Affixed to a lower end of the sleeve bushing 42, by a locking ring 50, is a stripper member 52. The stripper member 52 includes a lower foot or clamping portion 54 designed to engage and clamp the workpiece W against the region 14.

A pair of bushings 55 and 56 are provided generally at respective opposite ends of sleeve bushing 42. The two bushings 55 and 56 provide bearing surfaces for the piston rod 34 to move axially with respect to the sleeve bushing 42.

A shock absorber 60 is affixed to the locking ring 50. The shock absorber 60 can comprise a rubber block or like elastomeric element, and is intended to cushion movement of the locking ring 50 against a surface 62 of the frame 12 attendant to stripping of punch tool 36 from workpiece W.

It will be understood that the punch press and stripper 10 includes the necessary seals, mechanical fastening means, and the like as will be known to those with skill in the art. The exact structure of such elements is not a limitation of the present invention.

Figure 1:
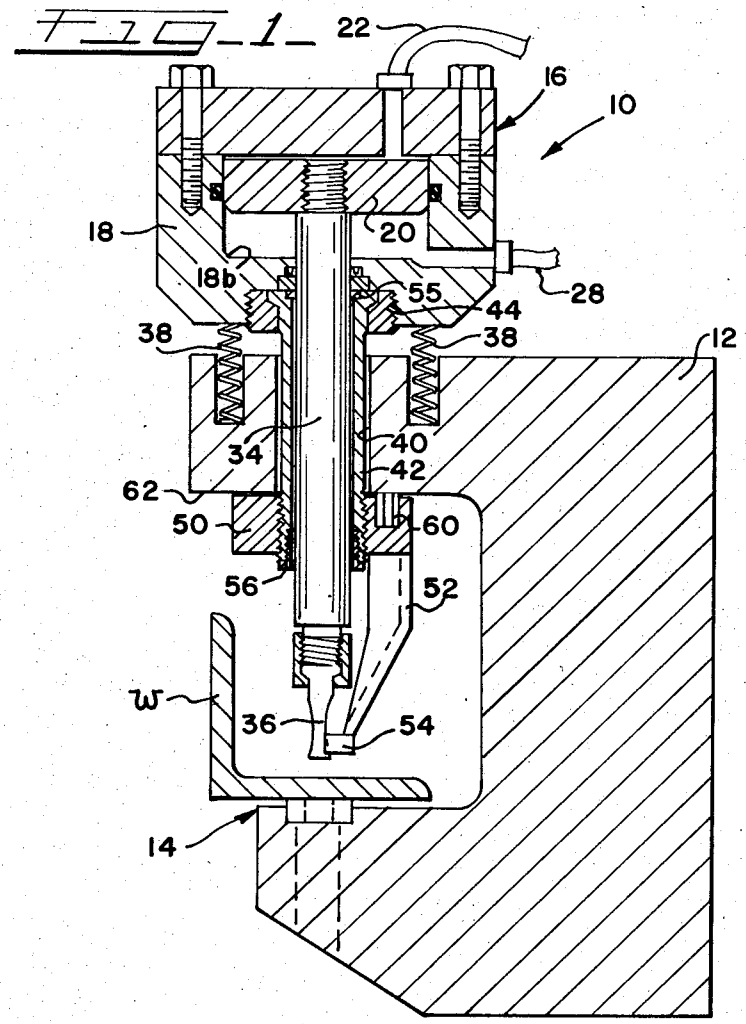
FIG. 1 is a diagrammatic side elevational view, in partial cross-section, of a punch press having a stripper in accordance with the present invention, with a tool-carrying fluid actuator piston in a retracted condition for commencing punching operations.
Figure 4:
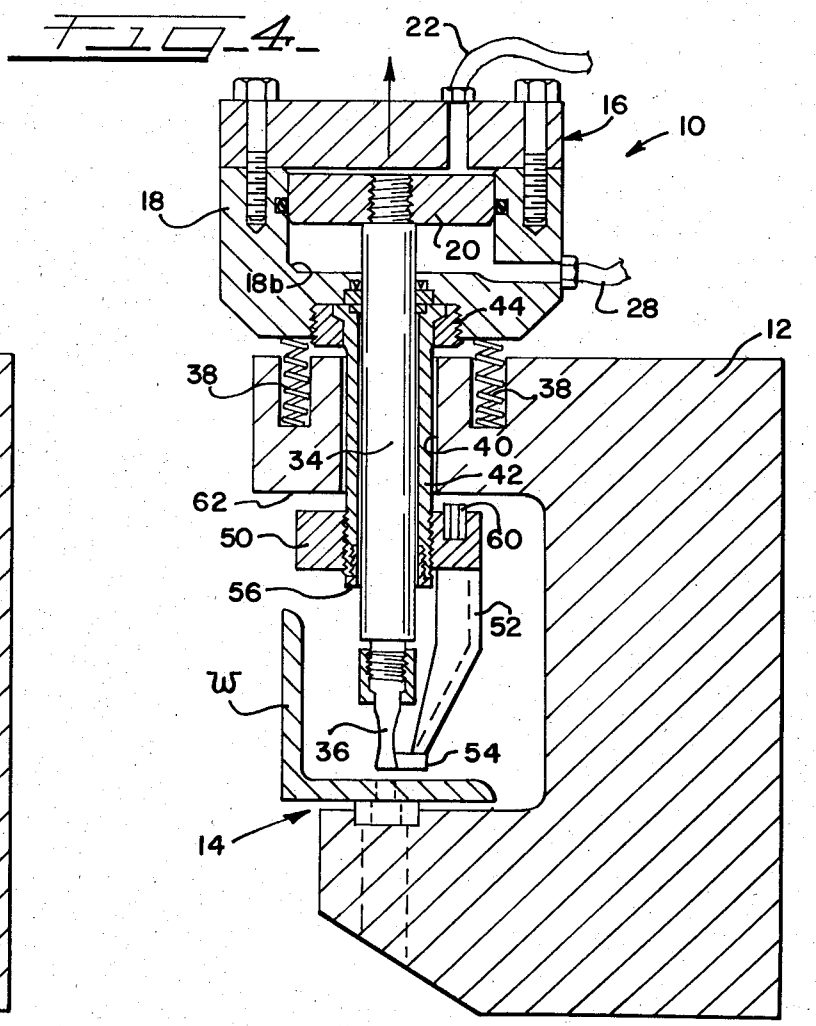
FIG. 4 is a side elevational view of the punch press and stripper of FIG. 1 illustrating the relative relationship between the tool-carrying actuator piston and stripper just after the tool has been withdrawn from the workpiece and the stripper is moving away from the workpiece to provide running clearance between the stripper and the workpiece.
Figure 3:
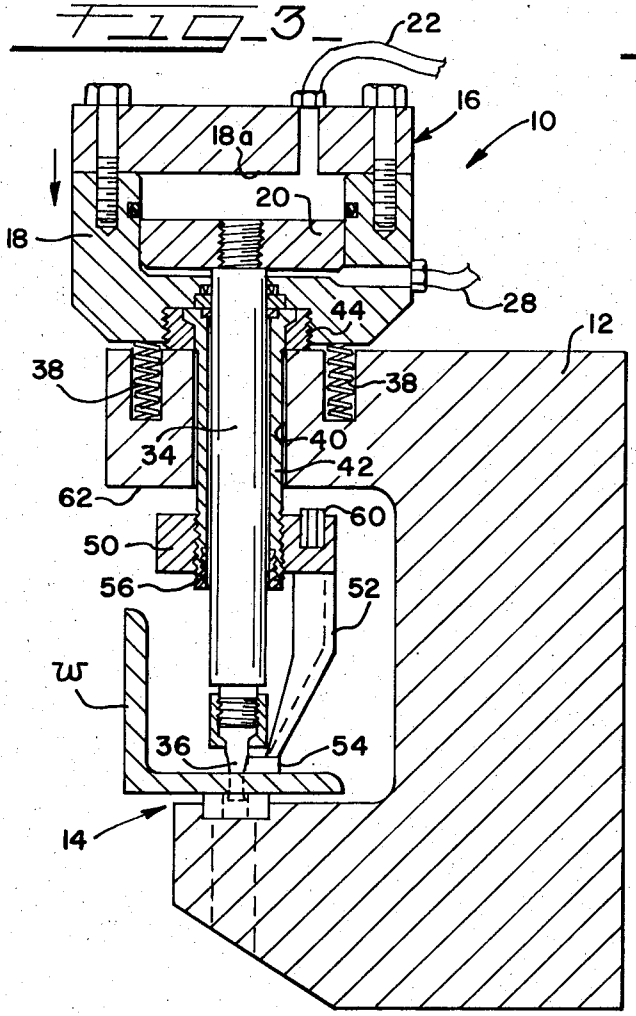
FIG. 3 is a further side elevational view of the punch press and stripper of FIG. 1 illustrating the relative relationship between the tool-carrying actuator piston and stripper when the press actuator has been operated for effecting a return stroke of the piston and the stripper has moved into contact with the workpiece.

FIGS. 2 through 4 sequentially illustrate the relative relationships of the various components of the punch press and stripper 10 of FIG. 1 during an operational sequence.

In FIG. 2, hydraulic fluid has been introduced into the region 18*a* of the cylinder 18 via the line 22 thus driving the piston 20 toward the workpiece W. As a result, the punch 36, as can be seen in FIG. 2, has been driven into the workpiece W for effecting punching thereof. The stripper unit 52 is in a retracted or clearance position with respect to the workpiece W and the springs or like biasing members 38 are in an uncompressed state. The locking ring or member 50 has moved against the surface 62 of the frame 12 in reaction to the downward movement of the piston 20.

FIG. 3 illustrates the stripping of punching tool 36 from the workpiece. As shown, pressurized hydraulic fluid is introduced into the region 18*b* of the actuator cylinder 18 via the line 28 for effecting the return stroke of piston 20 and piston rod 34. However, since the punch 36 is still firmly embedded in the workpiece W, neither the rod 34, nor the piston 20, are as yet free to move upwardly away from the workpiece W (i.e., the rod and piston are spacially fixed). The continuing flow of hydraulic fluid into the region 18*b* of the actuator cylinder 18 via line 28 results in the cylinder 18 being forced downwardly toward the workpiece W under the influence of the hydraulic fluid pressure. This movement of the cylinder 18 toward the workpiece W and the frame 12 is in opposition to and acts to compress the spring members 38.

The sleeve bushing 42, the coupled locking ring 50, and stripper unit 52, all being mechanically attached to the cylinder 18, also move forcibly toward the workpiece W. As a result, the clamping portion 54 of the stripper 52 engages the workpiece and firmly clamps the workpiece against the region 14 of the frame 12.

The punch 36 remains spacially fixed and embedded in the workpiece W, as illustrated in FIG. 3, until the increasing hydraulic pressure in the region 18*b* generates enough force to extract the punch from the workpiece W. However, while the extraction is taking place, the stripper 52 continues to securely clamp the workpiece W against the region 14.

FIG. 4 illustrates the punch 36 just after it has been extracted from the workpiece W, and is moving upwardly generally with respect to the frame 12. FIG. 4 also illustrates the stripper 52 moving away from the workpiece W under the influence of the biasing springs 38 as springs 38 move the actuator cylinder 18 upwardly against the force of gravity. The resilient cushion member 60 cushions the shock on the actuator 16 and the frame 12 as the sleeve bushing 42 and locking ring 50 move upwardly, and locking ring 50 moves into contact with the surface 62.

The punch press and stripper 10 thus will clamp the workpiece W during the stripping of the press punching tool, and at the same time provide a "self-adjusting" stripping action in that a large running clearance is normally provided between the stripper 52 and the workpiece. A further significant advantage of the present apparatus is found in the fact that no separate or independent source of movement or energy is necessary to actuate the stripper 52 other than the forces generated by the hydraulic fluid moving the actuator piston 20.

The sleeve bushing 42, as will be understood by those of skill in the art, must absorb the forces generated by the press 10 in tension and the stripping forces generated in compression.

It will also be understood that alternate energy sources can be used, such as pneumatics, instead of the exemplary hydraulics without departing from the spirit and scope of the present invention. Further, while a vertically-oriented press and stripper have been described, it will be understood that alternate configurations could be utilized in connection with the present invention.

From the foregoing, it will be observed that numerous modifications and variations can be effected without departing from the true spirit and scope of the novel concept of the present invention. It is to be understood that no limitation with respect to the specific apparatus illustrated herein is intended or should be inferred. It is, of course, intended to cover by the appended claims all such modifications as fall within the scope of the claims.

What is claimed is:

1. A punch press and stripper for clamping a workpiece while extracting a punching tool therefrom, comprising:

a supporting frame;

double-acting fluid actuator means mounted on said supporting frame for moving the tool toward or away from the workpiece, said actuator means including a housing resiliently coupled to said frame for limited movement with respect thereto, said actuator means further including a double-acting piston positioned in said housing and reciprocably movable relative thereto, said piston being operatively connected to said punching tool; and means for effecting stripping of said punching tool from said workpiece, said stripping means being operatively connected to said housing, and movable with said housing relative to said frame to clamp the workpiece as the actuator means is operated to extract the punching tool from the workpiece.

2. The punch press and stripper as in claim 1, wherein said housing is coupled to said frame with spring means.

3. The punch press and stripper as in claim 1 with said stripping means being movable to clamp the workpiece while the tool is being extracted in response to said housing moving relative to said piston.

4. The punch press and stripper as in claim 3, wherein said actuator means includes means for applying fluid pressure to said piston to cause movement thereof toward the workpiece and means for applying fluid pressure to said piston to cause limited movement of said housing and said stripping means, with respect to said frame, so as to clamp the workpiece while the tool is being extracted.

5. The punch press and stripper as in claim 4, wherein said frame defines a passage with an axially movable bushing therein, said stripping means being operatively connected to said actuator means housing by said movable bushing, said bushing and said stripping means being movable toward the workpiece in response to reverse fluid pressure being applied to said piston.

6. The punch press and stripper as in claim 5 including, first and second bearing means, coupled to said bushing, for slidingly supporting a piston rod therein which operatively connects said tool and said, piston.

7. The punch press and stripper as in claim 6, including shock absorbing means affixed to said stripper means.

8. A punch press for effecting punching of a workpiece, comprising:

a press frame;

double-acting actuator means mounted on said frame, including an actuator cylinder mounted for limited movement relative to said frame, and an actuator piston disposed within said cylinder for reciprocable movement within said cylinder attendant to selective fluid pressurization of said actuator means;

a tool-carrying piston rod operatively connected to said actuator piston for movement therewith, and a punching tool carried by said piston rod for effecting punching of said workpiece; and stripper means operatively connected to said actuator cylinder for movement therewith relative to said press frame, said stripper means being engageable with said workpiece for effecting extraction of said punching tool from said workpiece, whereby operation of said actuator means by selective fluid pressurization thereof to effect punching drives said piston and said piston rod toward said workpiece to drive said punching tool into the workpiece, and operation of said actuator means by reverse fluid pressurization thereof to effect a return stroke of said piston to extract said tool from said workpiece first moves said actuator cylinder relative to said press frame so that said stripper means moves against and engages said workpiece, with further reverse fluid pressurization effecting withdrawal of said tool from said workpiece as said stripper means clamps said workpiece against said press frame.

9. A punch press in accordance with claim 8, including sleeve means operatively connecting said stripper means to said actuator cylinder, said sleeve means extending through said press frame for relative movement with respect thereto, said piston rod extending through said sleeve means for movement with respect thereto.

10. A punch press in accordance with claim 8, including resilient biasing means operatively disposed between said press frame and said actuator cylinder for urging said cylinder and said stripper means away from said workpiece.

11. A punch press in accordance with claim 10, including elastomeric cushion means operatively disposed between said sleeve means and said press frame for cushioning relative movement therebetween as said punching tool is extracted from said workpiece.

12. A method of punching a workpiece and stripping a punching tool therefrom, comprising the steps of:

providing a punch press having a frame, and double-acting fluid actuator having a cylinder and reciprocable piston means movable within the cylinder, wherein the cylinder is mounted on the frame for limited movement with respect thereto;

providing a punching tool carried by the piston means for reciprocation therewith;

providing a stripper member operatively connected to the cylinder for movement therewith relative to the press frame;

positioning a workpiece on the frame, and operating the actuator to move the piston means to drive the tool into the workpiece; and operating the actuator to effect a return stroke of the piston means to withdraw the tool from the workpiece, whereby the cylinder and the stripper member first move relative to the frame toward the workpiece so that the stripper member engages the workpiece, with further operation of the actuator acting to withdraw the tool from the workpiece.

* * * * *